US005465886A

United States Patent [19]

Scherer

[11] Patent Number: 5,465,886

[45] Date of Patent: Nov. 14, 1995

[54] PACK

[75] Inventor: Michael J. Scherer, Boulder, Colo.

[73] Assignee: American Recreation Products, Inc., St. Louis, Mo.

[21] Appl. No.: 213,909

[22] Filed: Mar. 15, 1994

[51] Int. Cl.[6] ..... A45F 3/04

[52] U.S. Cl. ..... 224/215; 224/224; 224/262

[58] Field of Search ..... 224/215, 211, 224/208, 213, 221, 224, 258, 262; 24/265 AL, 182

[56] References Cited

U.S. PATENT DOCUMENTS

| | | | |
|---|---|---|---|
| 1,599,419 | 9/1926 | Klein | 224/224 X |
| 3,313,511 | 4/1967 | Koerner | 248/361 |
| 3,347,429 | 10/1967 | Ruth, Jr. . | |
| 3,653,566 | 4/1972 | Owens . | |
| 3,827,612 | 8/1974 | Mead et al. | 224/262 |
| 3,831,827 | 8/1974 | Olson . | |
| 4,133,464 | 1/1979 | Kelty | 224/262 |
| 4,175,304 | 11/1979 | Bentley | 24/197 |
| 4,332,379 | 6/1982 | Bannister | 272/119 |
| 4,618,353 | 10/1986 | Reier | 55/378 |
| 5,063,641 | 11/1991 | Chuan | 24/197 |
| 5,181,638 | 1/1993 | McHale | 224/215 |
| 5,228,609 | 7/1993 | Gregory | 224/224 |
| 5,240,157 | 8/1993 | Selhost | 224/215 |

FOREIGN PATENT DOCUMENTS

| | | | |
|---|---|---|---|
| 91/05493 | 5/1991 | WIPO | 224/215 |

*Primary Examiner*—Renee S. Luebke

*Attorney, Agent, or Firm*—Senniger, Powers, Leavitt & Roedel

[57] ABSTRACT

A pack includes a bag and a belt attached to the bag for releasably securing the pack around the torso of a person. The belt has a first flexible belt portion extending from the bag at one side of the torso of the person and terminating at a free end, and a second flexible belt portion extending from the bag at the other side of the torso of the person and terminating at a free end. A connecting device on each flexible belt portion releasably connects the belt portions to secure the belt around the torso of the person. The connecting device on the first belt portion is movable longitudinally along the length of the first belt portion for shortening and lengthening the first belt portion when tightening the belt about the person's torso. The pack further has a rigid loop affixed to the pack adjacent to the first belt portion. Whereby, when the connecting devices are interengaged to secure the belt around the torso of the person, the free end of the first belt portion is adapted to be inserted through the loop and then pulled against the loop to cinch the belt tight around the person's torso.

15 Claims, 3 Drawing Sheets

FIG. 3
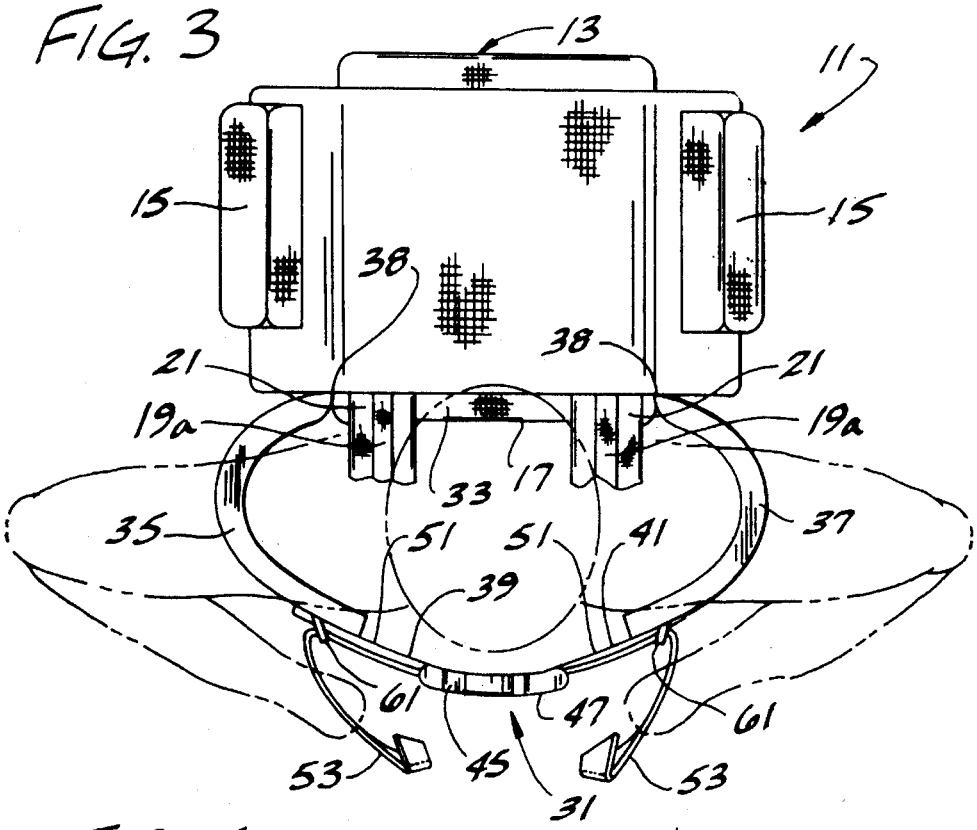
FIG. 4
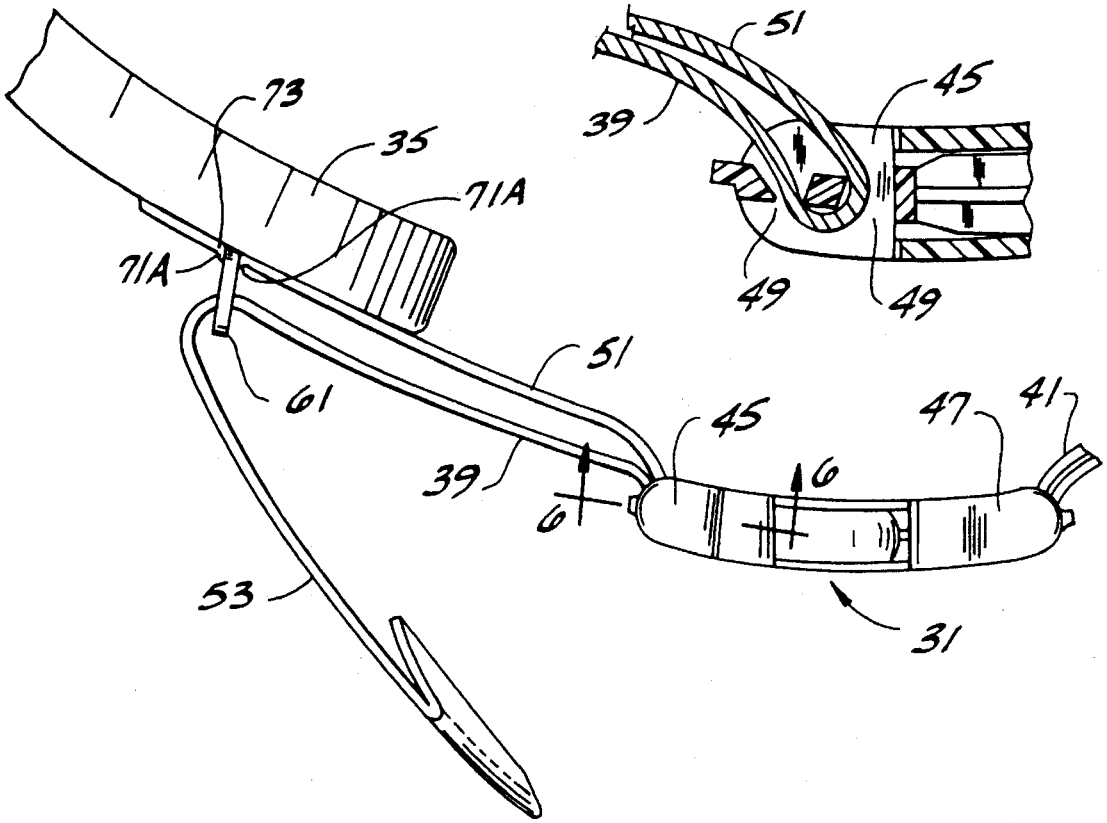
FIG. 6

PACK

BRIEF SUMMARY OF THE INVENTION

This invention relates generally to packs and more particularly to a pack capable of being cinched tightly around a person's torso.

This invention is in the same general field as back packs having waist and shoulder straps for releasably securing the pack on a person's back and represents an improvement over prior designs.

Among the several objects of this invention may be noted the provision of an improved pack having a belt which may be easily and tightly cinched around a person's torso; and the provision of such a pack which is simple in design and construction and easy to use.

In general, this invention involves a pack comprising a bag and a belt attached to the bag for releasably securing the pack around the torso of a person. The belt comprises a first flexible belt portion extending from the bag at one side of the torso of the person and terminating at a free end, and a second flexible belt portion extending from the bag at the other side of the torso of the person and terminating at a free end. A connecting device on each flexible belt portion releasably connects the belt portions to secure the belt around the torso of the person. The connecting device on the first belt portion is movable longitudinally along the length of the first belt portion for shortening and lengthening the first belt portion when tightening the belt about the person's torso. The pack further comprises a rigid loop affixed to the pack adjacent to the first belt portion. When the connecting devices are interengaged to secure the belt around the torso of the person, the free end of the first belt portion is adapted to be inserted through the loop and then pulled against the loop to cinch the belt tight around the person's torso.

Other objects and features will be in part apparent and in part pointed out hereinafter.

BRIEF DESCRIPTION OF THE DRAWINGS

FIG. 3 is a top plan of the pack shown in FIG. 1;

FIG. 4 is an enlarged top plan of a belt of the pack inserted through the rigid loop;

FIG. 6 is an enlarged cross section taken along line 6—6 of FIG. 4.

Corresponding reference characters indicate corresponding parts throughout the drawings.

DETAILED DESCRIPTION OF THE PREFERRED EMBODIMENT

Figure 1:
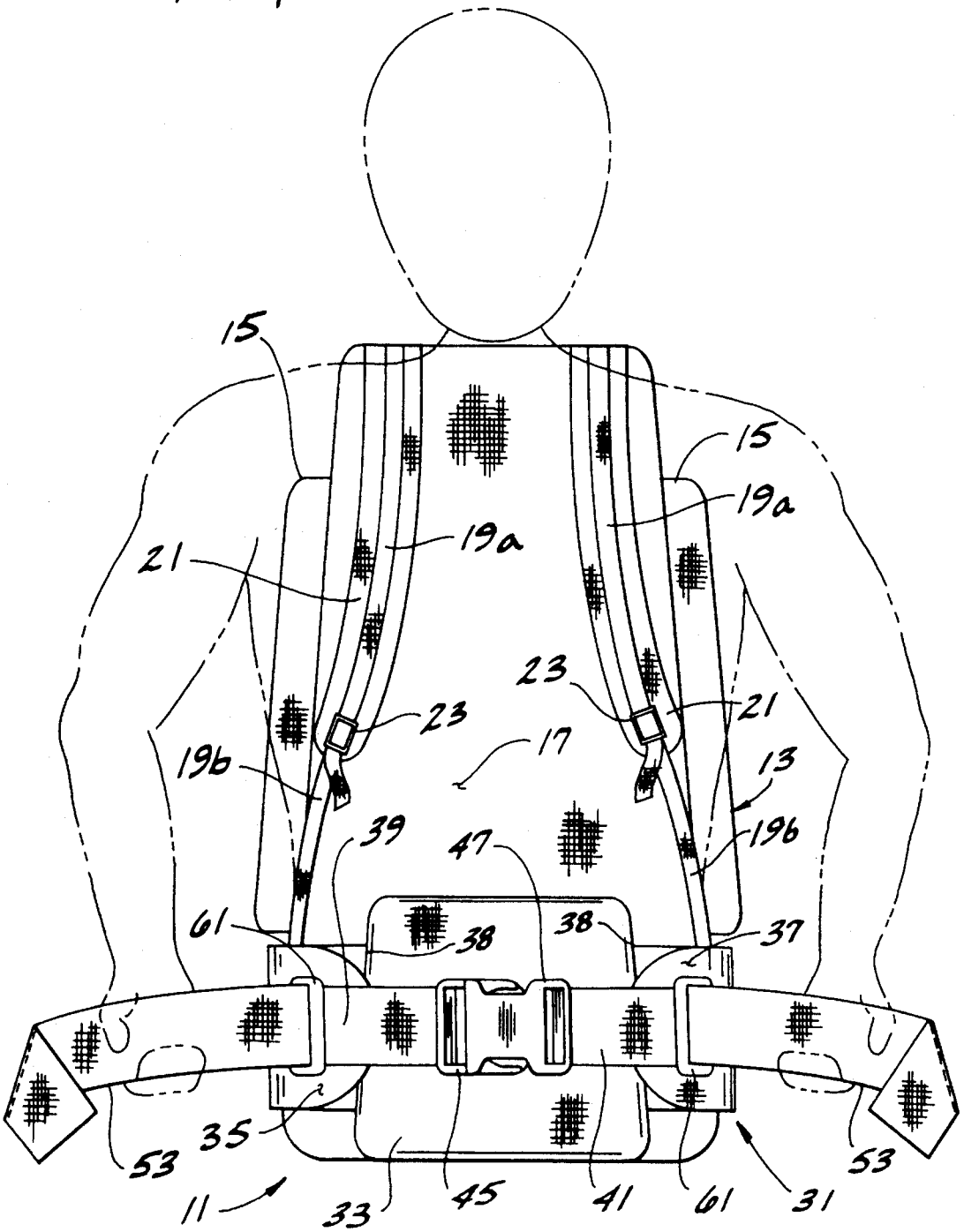
FIG. 1 is a front elevation of a pack of the present invention as it is worn by a person (shown in phantom)

Referring now to the drawings, a pack, and more specifically a back pack, of the present invention is indicated in its entirety by the reference numeral 11. FIG. 1 illustrates the manner in which the back pack 11 is to be worn on a person's back. In the embodiment shown, back pack 11 is frameless and comprises a load carrier, such as a bag (generally designated 13), constructed of flexible sheet material (e.g., nylon). The bag 13 is of conventional construction and includes a compartment accessible through an opening which is closed by a zipper (not shown). Two smaller compartments 15 are located on opposite sides of the bag 13 and are also accessible through openings closed by zippers (not shown). It is to be understood that the bag 13 may be constructed in any number of ways (including having an internal or external frame supporting the bag) and still fall within the scope of the present invention. The bag 13 includes a front wall 17 which, when worn, is positioned against a person's back (see FIG. 5). The front wall 17 is constructed to have a relatively thin layer of foam material sealed between two nylon sheets. Two rigid strips (not shown) stiffen the wall 17.

A shoulder harness is provided for securing the back pack 11 about the person's upper body. The harness comprises a pair of shoulder strap systems each of which includes a flexible top strap (designated **19*a*) attached at its upper end to the bag 13 near the top of the bag and a flexible bottom strap (designated 19*b*) attached at its lower end to the bag near the bottom of the bag. As shown, each top strap has padding 21 attached (e.g., by stitching) to its bottom surface for engaging a person's shoulder when wearing the back pack 11. Respective top and bottom straps 19*a*, 19*b* are releasably and adjustably connected in a conventional manner by a buckle 23 which is fixedly attached to the top strap 19*a* and receives the upper free end of the bottom strap 19*b*. The upper free ends of the bottom straps 19*b*** are pulled downwardly to tighten the harness about the person's shoulders.

A belt, generally designated 31, releasably secures the back pack 11 around a person's torso. Belt 31 comprises a cushion 33 which is attached (e.g., by stitching) to the wall 17 of the bag 13 near the bottom of the bag so that the cushion engages the lower back of the person wearing the back pack 11. As viewed in FIGS. 1 and 5, the belt 31 also comprises an elongate, left-hand waist pad 35 which extends from the left-hand side of the cushion 33 near the bottom of the bag 13 and an elongate right-hand waist pad 37 which extends from the right-hand side of the cushion 33. Cushion 33 and waist pads 35, 37 may be constructed of foam material encased by two panels of sheet material. As illustrated in FIG. 3, the waist pads 35, 37 are sewn to the bag 13 of the back pack at 38. They extend out from opposite sides of the back cushion 33 on opposite sides of the torso of a person wearing the back pack 11 and wrap around the person's torso.

The belt 31 further comprises a first strap 39 of flexible material (e.g., nylon) sewn to the outer surface of the left-hand waist pad 35 generally adjacent a forward end of the pad and a second flexible strap 41 sewn to the outer surface of the right-hand waist pad 37 generally adjacent a forward end of the pad. As shown, the waist pads 35, 37 are wide compared to the relatively narrower straps 39, 41. The free ends of the straps 39, 41 are folded over and stitched in the manner illustrated. Like the harness, the belt 31 is capable of being tightened so that the back pack 11 is relatively secure about a person's torso.

Figure 5:
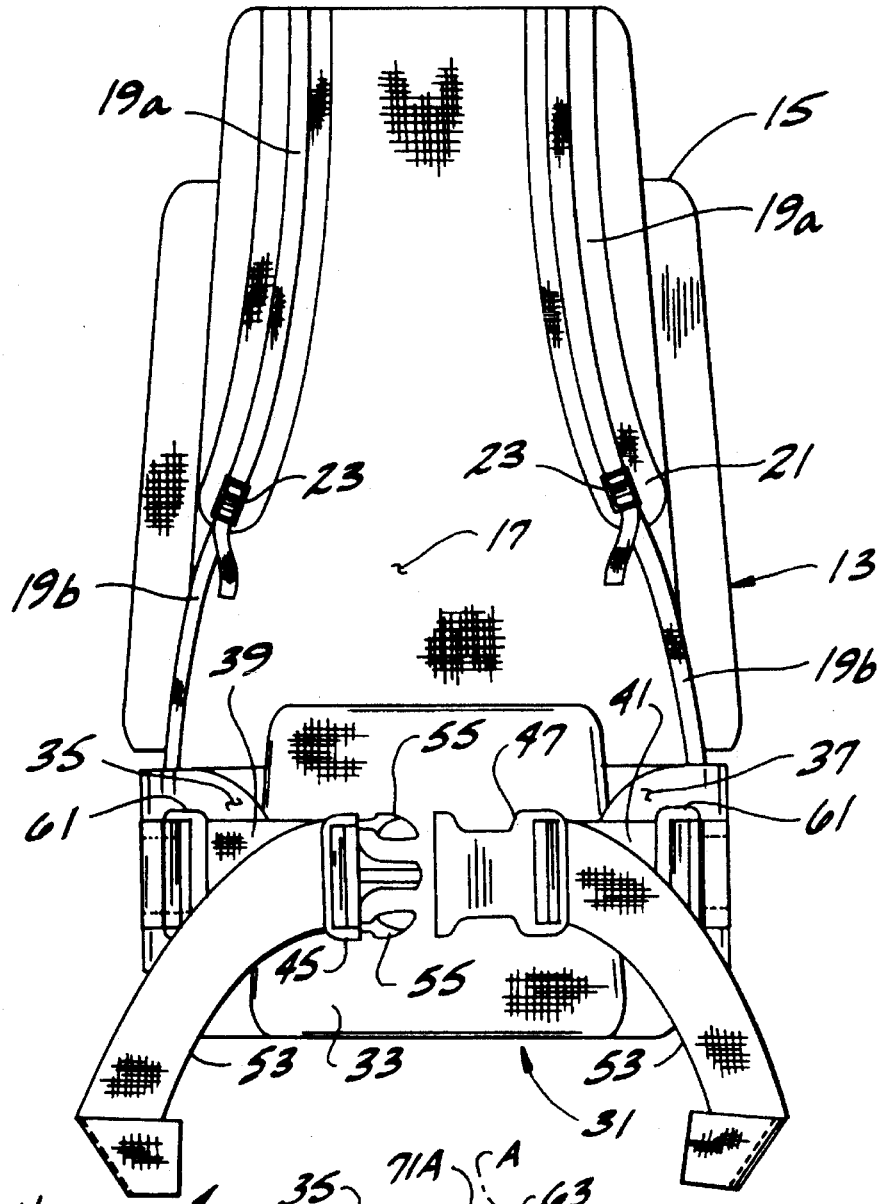
FIG. 5 is a front elevation of the pack showing the belt of the pack being disconnected.

The free ends of the first and second straps 39, 41 are releasably connected to one another by a two-part connector best illustrated in FIG. 5. The connector includes a male connecting device 45 releasably attached to the first strap and a female connecting device 47 releasably attached to the second strap 41. These connecting devices 45, 47, are made from hard synthetic material, and each has two slots (designated 49 in FIG. 6) formed therein for receiving and securing the respective free ends of the straps 39, 41. The straps 39, 41 are threaded through the slots 49 in the manner illustrated in FIG. 6 so that the connecting devices 45, 47 are movable longitudinally along the lengths of respective straps for shortening and lengthening the straps. The connecting devices 45, 47 are designed to maintain the straps 39, 41 in their shortened condition when tightening the belt 31 about the person's torso.

Each strap 39, 41 has an inner reach 51 affixed at one end to its respective left-hand or right-hand waist pad 35, 37. The inner reach 51 extends from the waist pad to its respective connecting device 45, 47 and is threaded through the two slots 49 therein (see FIG. 6). Each strap 39, 41 also has an outer reach 53 which extends outwardly from the inner reach 51 and a respective connecting device 45, 47 to the free end of the strap.

The belt 31 may be releasably attached about a person's torso by snap-fitting the male connecting device 45 into the female connecting device 47. The male connecting device 45 has two resiliently flexible prongs 55 (see FIG. 5) which are releasably held captured in the female connecting device 47. The male connecting device 45 may be released from the female connecting device 47 by forcing the two prongs 55 toward one another.

Figure 2:
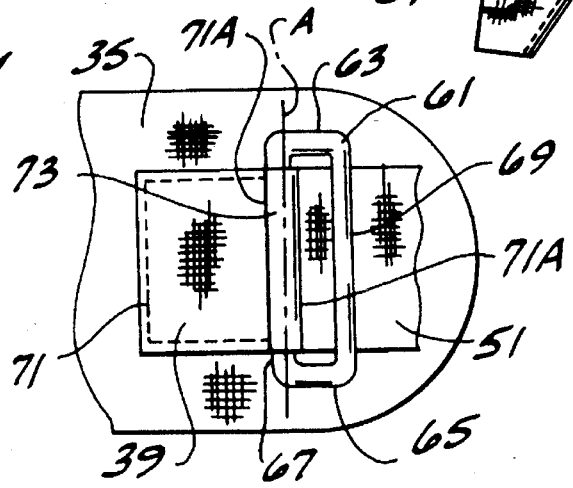
FIG. 2 is an enlarged partial side elevation showing a rigid loop of the pack.

Two rigid loops (each loop being designated 61), one for each strap 39, 41, are provided for cinching the belt 31 and tightening it about the person's torso. For each strap 39, 41, a rigid loop 61 is affixed to the back pack 11 adjacent to where the inner reach 51 is attached to its respective waist pad 35, 37. The rigid loops 61 may be constructed of hard synthetic material, for example, or from metal, such as stainless steel. FIG. 2 illustrates the left-hand rigid loop 61 which is of identical construction to the right-hand loop. As shown in FIG. 2, loop 61 is rectangular in shape and has a top segment 63, a bottom segment 65 and two opposite side segments 67, 69. Other loop shapes are also suitable. The left-hand side segment (67 as viewed in FIG. 2) is secured to the waist pad 35 for pivotal movement of the loop 61 about a generally vertical axis A. Each rigid loop 61 is pivotable on its respective waist pad 35, 37 about the axis A between a first position in which it projects laterally out from the waist pad to facilitate insertion of the outer reach 53 of its respective strap through the loop, and a second position in which the loop lies generally flat against the waist pad.

FIGS. 2 and 4 illustrate how the loop 61 is attached to the left-hand waist pad 35. As shown, the end of the inner reach 51 of strap 39 is positioned on the waist pad 35 and secured thereto by a pattern of stitching indicated at 71. The strap 39 extends through the loop 61 and is stitched at 71A on opposite sides of the left-hand segment 67 to form a sleeve 73 which holds the loop so that it may pivot about axis A. The other loop 61 is attached to the right-hand waist pad 37 in an identical manner.

After snap-fitting the connecting devices 45, 47 together, the outer reaches 53 of the straps 39, 41 are inserted back through their respective loops 61 in a generally rearward direction, and then are pulled in a generally forward direction against the loops to cinch the belt 31 tight around the person's torso. The openings of the rigid loops 61 are sized for receiving the outer reaches 53 of the straps 39, 41 therethrough, as shown in FIGS. 1 and 5. FIG. 3 illustrates a person pulling the outer reaches 53 of the first and second straps 39, 41 to cinch both of the straps tight. FIG. 4 is an enlarged view of the left-hand outer reach 53 inserted in a generally rearward direction through the loop 61 and pulled in a generally forward direction against the loop for cinching the belt 31. This cinching action shortens the inner reach 51 which in turn tightens the belt 31 around the person's torso. The rigid loops 61 provide a mechanical advantage, which reduces the force necessary to effect the tightening and enables tighter securement of the belt 31 about the torso. The folded over ends of the straps 39, 41 function to restrict passage of the free ends of the straps back through their respective loops 61. Stops (not shown) attached to the free ends of the straps may also perform this function.

It should be observed that only one of the straps 39 or 41 need be adjustable and that only one rigid loop 61, associated with the adjustable strap, need be provided to cinch the belt 31. However, the provision of two adjustable straps and two rigid loops makes it even easier for a person wearing the back pack to cinch the belt 31 tight.

In use, the back pack 11 is secured to a person's back in the following manner. Before donning the back pack, the shoulder straps **19*b* of the harness and inner reaches 51 of the belt straps 39, 41 should be lengthened. This makes it easier for the arms to be inserted through the straps 19*a*, 19*b* of the harness and for positioning the bag 13 of the back pack 11 against the person's back. The free ends of the bottom straps 19*b* of the harness are pulled in a downward direction for tightening the harness. The male and female connecting devices 45, 47 of the belt 31 are then snap-fitted together, following which, the outer reaches 53 of each strap 39, 41 are inserted through their respective rigid loops 61 and pulled against the loops for cinching the belt 31** tight around the person's torso. It will be apparent, therefore, that adjustment of the shoulder straps to tighten the straps on the shoulders is effected in a manner independent of adjustment of the belt to tighten the belt around the torso.

To remove the back pack 11, the belt connecting devices 45, 47 are released from one other by forcing the two prongs 55 of the male connecting device 45 toward one another. The person may then slip his arms out from under the straps **19*a*, 19*b* of the harness. The straps 19*b* of the harness and the inner reaches 51 of the straps 39, 41 of the belt 31** may be lengthened before the back pack is put on again.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A pack comprising a load carrier and a belt attached to the load carrier for releasably securing the pack around a torso of a person, said belt comprising a first flexible belt portion extending forwardly from the load carrier at one side of the torso of said person and terminating at a free end, and a second flexible belt portion extending forwardly from the load carrier at the other side of the torso of said person and terminating at a free end, a connecting device on each flexible belt portion for releasably connecting the belt portions to secure the belt around the torso of said person, the free end of the first belt portion extending from the connecting device on the first belt portion after the connecting devices on the belt portions have been connected, said connecting device on the first belt portion being movable longitudinally along the length of the first belt portion for shortening and lengthening the first belt portion when tightening the belt about the person's torso, said pack further comprising a rigid loop affixed to the first belt portion rearwardly of the connecting device on the first belt portion, the first belt portion having a length such that when said connecting devices are interengaged to secure the belt around the torso of said person, the free end of the first belt portion can be inserted through the rigid loop and then pulled generally forwardly against the loop thereby to cause relative movement between the first belt portion and its respective connecting device to cinch the belt tight around the person's torso.

2. A pack as set forth in claim 1 wherein said first flexible belt portion comprises a first strap and the second flexible belt portion comprises a second strap.

3. A pack as set forth in claim 2 wherein said first strap has an inner reach affixed to the pack and extending forwardly therefrom to a respective connecting device, and an outer reach extending from the inner reach at said connecting device.

4. A pack as set forth in claim 3 wherein the outer reach of the first strap extends generally rearwardly from said connecting device through the rigid loop and then forwardly so that the outer reach of the first strap may be pulled against the loop to cinch the belt tight around the person's torso.

5. A pack as set forth in claim 1 wherein said connecting device on the second belt portion is movable longitudinally along the length of the belt portion for shortening and lengthening the second belt portion, said pack further comprising a second rigid loop affixed to the pack adjacent the second belt portion, whereby when said connecting devices are interengaged to secure the belt around the torso of said person, the free end of the second belt portion is adapted to be inserted through the second loop and then pulled against the second loop to cinch the belt tight around the person's torso.

6. A pack as set forth in claim 5 wherein said first flexible belt portion comprises a first strap and the second flexible belt portion comprises a second strap.

7. A pack as set forth in claim 6 wherein each of said first and second straps has an inner reach affixed to the pack and extending forwardly therefrom to a respective connecting device, and an outer reach extending from the inner reach at its respective connecting device.

8. A pack as set forth in claim 7 wherein the outer reach of each strap extends generally rearwardly from its respective connecting device through its respective rigid loop and then forwardly so that the outer reach may be pulled against the loop to cinch the belt tight around the person's torso.

9. A pack as set forth in claim 1 wherein each flexible belt portion comprises a relatively wide waist pad attached to the load carrier of the pack and extending forwardly therefrom at a respective side of the person wearing the pack, and a narrower strap attached to the waist pad generally adjacent a forward end of the pad, said strap having an inner reach extending forwardly from the pad to a respective connecting device, and an outer reach extending from the inner reach, and means for affixing said rigid loop to one of said waist pads, the arrangement being such that said outer reach of a respective strap is adapted to extend generally rearwardly from said connecting device to said rigid loop and through said loop so that the outer reach may be pulled in a generally forward direction against the loop to cinch the belt tight around the person.

10. A pack as set forth in claim 9 wherein said belt further comprises a back cushion on the load carrier engageable with the lower back of a person wearing the pack, said waist pads extending out from opposite sides of the back cushion on opposite sides of the torso of a person wearing the pack.

11. A pack as set forth in claim 9 wherein said rigid loop is pivotable on said one waist pad about a generally vertical axis between a first position in which it projects laterally out from the waist pad to facilitate insertion of said outer reach of the strap through the loop, and a second position in which the loop lies generally flat against the waist pad.

12. A pack as set forth in claim 11 wherein the loop is generally rectangular in shape and has a top segment, a bottom segment and two opposite side segments, one of said side segments being secured to said waist pad for pivotal movement of the loop about said axis.

13. A pack as set forth in claim 1 wherein said load carrier comprises a bag constructed of flexible sheet material.

14. A pack as set forth in claim 1 further comprising a shoulder harness comprising a pair of shoulder strap systems, one for each shoulder of a wearer of the pack, attached to the load carrier, the shoulder straps systems being adjustable to fit the shoulders of the wearer independent of pulling said first belt portion against said rigid loop member to cinch the belt tight around the torso of said person.

15. A pack as set forth in claim 14 wherein each shoulder strap system comprises a top strap having an upper end extending down from the load carrier over a respective shoulder of the wearer of the pack, a bottom strap extending up from the load carrier, and a buckle for adjustably connecting the top and bottom straps to permit the shoulder strap system to be tightened on the shoulder.

* * * * *